US011622574B2

(12) United States Patent
Awuondo

(10) Patent No.: US 11,622,574 B2
(45) Date of Patent: Apr. 11, 2023

(54) SMOKING PRODUCT STORAGE APPARATUS

(71) Applicant: Benjamin Awuondo, Toronto (CA)

(72) Inventor: Benjamin Awuondo, Toronto (CA)

( * ) Notice: Subject to any disclaimer, the term of this patent is extended or adjusted under 35 U.S.C. 154(b) by 0 days.

(21) Appl. No.: 17/581,919

(22) Filed: Jan. 22, 2022

(65) Prior Publication Data

US 2022/0232888 A1 Jul. 28, 2022

Related U.S. Application Data

(60) Provisional application No. 63/140,829, filed on Jan. 23, 2021.

(51) Int. Cl.
*A24F 15/18* (2006.01)
*A24F 15/12* (2006.01)
*A24F 15/20* (2006.01)

(52) U.S. Cl.
CPC ..... *A24F 15/12* (2013.01); *A24F 15/18* (2013.01); *A24F 15/20* (2013.01)

(58) Field of Classification Search
CPC ..... A24F 13/18; A24F 13/24; A24F 13/02; A24F 19/0064; A24F 15/20; A24F 15/18; A24F 15/12
USPC ..... 206/85, 242; 131/175, 178
See application file for complete search history.

(56) References Cited

U.S. PATENT DOCUMENTS

| | | | | |
|---|---|---|---|---|
| 5,996,783 | A | 12/1999 | Herchelroth | |
| 6,536,441 | B2 | 3/2003 | Chuan | |
| 2003/0029744 | A1* | 2/2003 | Holler | A24F 15/02 206/256 |
| 2012/0261276 | A1 | 10/2012 | Chuan | |
| 2016/0355318 | A1* | 12/2016 | Epenetos | B65D 81/24 |
| 2019/0283935 | A1* | 9/2019 | Skiba | B65D 25/02 |

FOREIGN PATENT DOCUMENTS

| | | |
|---|---|---|
| CA | 2203596 | 4/1997 |
| CN | 202068927 U | 12/2011 |
| CN | 202107219 U | 1/2012 |
| CN | 202179120 U | 4/2012 |
| DE | 20 2011 050 982 U1 | 12/2011 |

* cited by examiner

*Primary Examiner* — King M Chu
(74) *Attorney, Agent, or Firm* — Southern Plains IP Law PLLC; Sue C. Watson

(57) ABSTRACT

A storage apparatus for storage of a smoking product includes a container having a perimeter wall having an upper end with an opening formed therein defining a storage area, and a closed lower end. The storage apparatus also includes a carriage having a closed upper end including a cap, a closed lower end, and a perimeter wall positioned therebetween forming a housing. An opening formed in the housing permits insertion and withdrawal of a smoking product. The carriage is configured to be inserted into the container and withdrawn from the container. The container is closed and opened by a releasable connection between the cap of the carriage and the upper end of the container.

38 Claims, 13 Drawing Sheets

SMOKING PRODUCT STORAGE APPARATUS

FIELD OF THE INVENTION

The present invention relates to a storage apparatus for smoking products, such as a rolled smoking product. More particularly, the present invention relates to a smoking product storage apparatus which includes a container including an inner carriage configured to carry a smoking product.

BACKGROUND

Rolled smoking products, such as for example, but not by way of limitation, tobacco products such as cigarettes, cigars, cigarillos, and the like, cannabis (marijuana) smoking products, colloquially referred to as joints, blunts, spliffs, and the like, herbal blend smoking products, such as herbal cigarettes, and herbal joints, and the like, are typically fragile. Each of these smoking products may be stored in a variety of containers, such as boxes, cases, tubes, and the like, prior to consumption.

One storage apparatus for storing such rolled smoking products is a tube and cap combination. The smoking product is slid into the tube and the tub is closed via the cap. For removal, the cap is removed, the tube is inverted, and the smoking product slides from the tube via gravity. In each instance, a length of the delicate outer surface of the smoking product is rubbed against the inner surface of the tube via both insertion and extraction.

Such storage products have a variety of sealing methods and are made from a range of materials, however they may share the commonality of needing to tip out any product stored within the container. Some caps integrate a holding mechanism, which actively touch and hold the smoking product within the storage apparatus.

Further, many types of storage apparatus for smoking products require that the partially smoked product to be positioned with the previously lit end (the previously burning end) of the smoking product suspended downwards, which results in damage to the partially smoked product. Further, the effects of gravity may cause a release of loose product held within the partially smoked product, which may result in the inability of a user to further smoke the smoking product.

In addition, storage apparatus for smoking products also may include holding mechanisms, which are typically limited to the shape and/or rigidity of a held end of a rolled smoking product. This is because such holding mechanisms rely on an interference fit between the holding mechanism and the smoking end of the rolled smoking product. That is, the holding mechanism may damage or not hold a smoking product rolled without a filter, because such smoking products often have less rigidity and are likely to be damaged by the interference fit. Additionally, if the smoking end of the smoking product has a greater diameter than the holding mechanism, the storage apparatus is usually rendered useless.

What is needed is a storage apparatus for a smoking product which does not require sliding the product within the tube or container to insert it, or inverting the tube or container to remove the smoking product, thereby protecting the delicate outer surface of the smoking product, which in many smoking products hold the internal smoking product in a position to be smoked. In the case of a partially smoked product, a storage apparatus which holds the partially smoked product while reducing or eliminating damage to the outer surface of the smoking product, or a further loss of product therein during storage would be desirable.

SUMMARY OF THE INVENTION

In one embodiment of the invention, a storage apparatus for storing a smoking product comprises a container having a perimeter wall having an upper end with an opening formed therein defining a storage area, and a closed lower end. The storage apparatus also includes a carriage having a closed upper end including a cap, a closed lower end, and a perimeter wall positioned the closed upper end and the closed lower end which forms a housing. An opening formed in the housing permits insertion and withdrawal of a smoking product. The carriage is configured to be inserted into the container and withdrawn from the container. And the container is closed and opened by a releasable connection between the cap of the carriage and the upper end of the container.

In an aspect of the embodiment, an outer perimeter of the carriage is smaller than an inner perimeter of the container.

In another aspect of the embodiment, the carriage includes a disk configured to be flexibly positioned within the housing of the carriage and to be positioned against an end of the smoking product to hold the smoking product in a fixed position within the housing.

In still another aspect of the embodiment, an outer perimeter of the cap is substantially equivalent to an outer perimeter of the container formed below the upper end outer perimeter thereof. The cap includes a sleeve, and a portion of the upper end of the container is held within the sleeve when the storage apparatus is in a closed position. The cap of the carriage and the upper end of the container include means for connecting the carriage and the container together, namely, a plurality of detents on an upper end of the container and a detent recess formed within the sleeve of the cap of the carriage. The storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

In a further aspect of the embodiment, the carriage includes a door to close the opening in the housing.

In another aspect of the embodiment, the closed end of the carriage includes a spool assembly which includes a rod and spaced-apart disk connected thereto. The spool assembly is configured to receive a lighting product wound about the rod between the closed end of the carriage and the disk. The lighting product is used to light the smoking product.

In yet another aspect of the embodiment, the cap includes a lighter for lighting the smoking product.

In still yet another aspect of the embodiment, the storage apparatus comprises a plurality of carriages and the container is configured to receive the plurality of carriages.

In yet a further aspect of the embodiment, the storage apparatus comprises a plastic, a metal, a wood, and combinations thereof.

And in yet still another aspect of the embodiment, the storage apparatus is manufactured at least partially from at least one of additive manufacturing, injection molding, and machining.

An another embodiment of the invention, aspect of the in a method of using a storage apparatus for storing a smoking product comprises providing a container having a perimeter wall having an upper end with an opening formed therethrough defining a storage area, and a closed lower end. The method also includes providing a carriage having a closed upper end including a cap, a closed lower end, and a perimeter wall positioned therebetween forming a housing. An opening is formed in the housing to permit insertion and withdrawal of a smoking product. The method further includes inserting the smoking product into the opening in the housing of the carriage. And, the method includes inserting the carriage into the storage area of the container. In addition, the method includes connecting the cap of the carriage to a portion of the perimeter wall adjacent to the upper end of the container.

In an aspect of the other embodiment, the method further comprises withdrawing a smoking product held within the carriage which is positioned in a storage area of the container by disconnecting the cap of the carriage from the portion of the perimeter wall adjacent to the upper end of the container to open the container, moving the carriage at least partially out of the container, and accessing the smoking product through the opening in the housing of the carriage to withdraw the smoking product from the carriage.

In yet another aspect of the other embodiment, the method includes providing a door for the carriage, positioning the door to close the opening into the housing, and moving the door to open access to the housing.

In still another aspect of the other embodiment, the method includes providing a disk for positioning the smoking product within the housing.

In a further aspect of the other embodiment, the method includes providing a spool assembly including a hemp cord.

In an additional aspect of the other embodiment, the method includes providing a lighter positioned in the cap.

And in yet another aspect of the embodiment, the method includes providing a plurality of carriages the container is configured to carry a plurality of carriages.

The features and functions can be achieved independently in various embodiments of the present disclosure or may be combined in yet other embodiments in which further details can be seen with reference to the following drawings and descriptions.

BRIEF DESCRIPTION OF THE DRAWINGS

The novel features believed characteristic of the illustrative embodiments are set forth in the appended claims. The illustrative embodiments, however, as well as a preferred mode of use, further objectives and descriptions thereof, will best be understood by reference to the following detailed description of one or more illustrative embodiments of the present disclosure when read in conjunction with the accompanying drawings, wherein:

DETAILED DESCRIPTION

The following detailed description describes various features and functions of the disclosed systems and methods with reference to the accompanying figures. The illustrative system and method embodiments described herein are not meant to be limiting. It may be readily understood that certain aspects of the disclosed systems and methods can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. The variations of "comprising", "including" and "having", such as, but not by way of limitation, "comprise", "include", "have" or "has", are also included in this definition. Any examples of operating parameters and/or environmental conditions are not exclusive of other parameters/conditions of the disclosed embodiments.

The term "substantially," as used herein, means within 5 percent (+2.5 percent or −2.5 percent) of the recited parameter, range, or value as described herein.

Figure 1A:
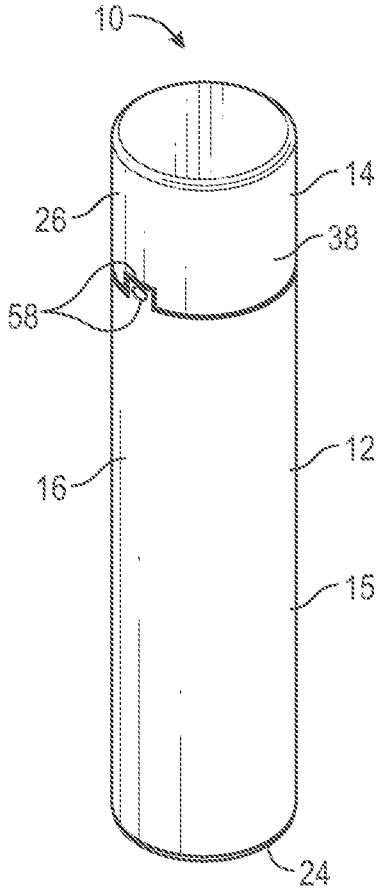
FIG. 1A is a perspective view of the storage apparatus for a smoking product of the present invention.
Figure 1B:
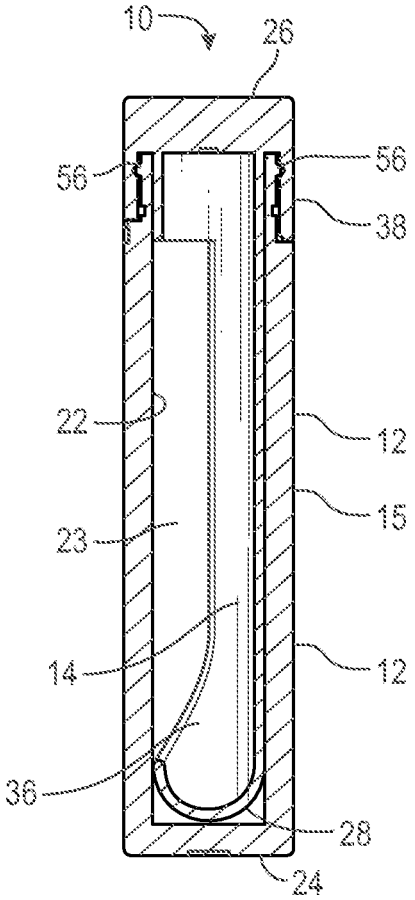
FIG. 1B is a cross-sectional view of FIG. 1A, illustrating the container and the carriage held therein.
Figure 3A:
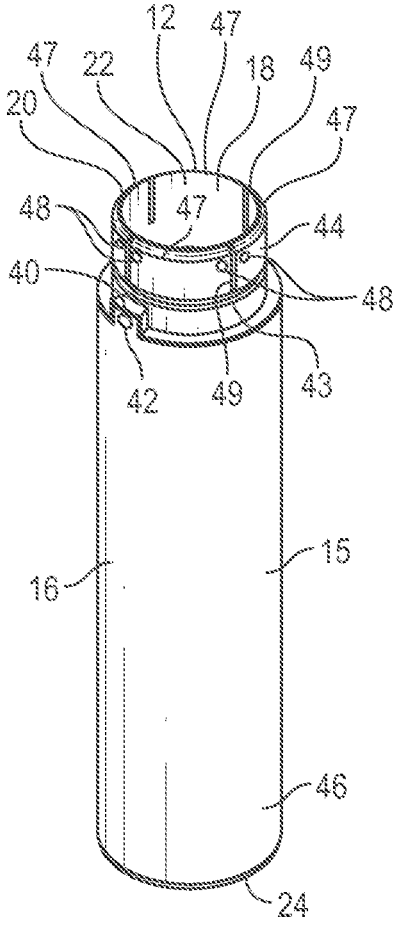
FIG. 3A is a perspective view of the container of the storage apparatus of FIG. 1A, but showing only the container.
Figure 3B:
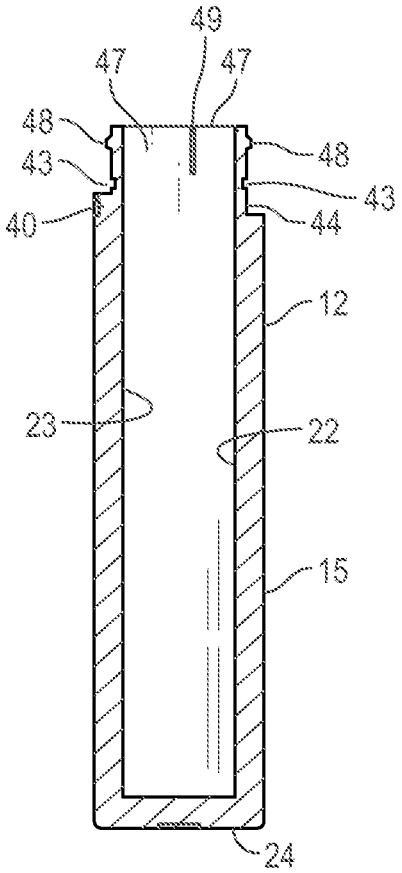
FIG. 3B is a cross-sectional view of FIG. 3A.

Turning to one embodiment, FIGS. 1A and 1B illustrate a storage apparatus for smoking products 10. The storage apparatus 10 includes a container 12 and an inner container or carriage 14. As shown in FIGS. 3A and 3B, the container, for example, but not by way of limitation, is tubular and includes a cylindrical perimeter wall 15 having an outer peripheral surface 16 and an opening 18 in an upper end 20 forming an inner surface 22 and a storage area 23 configured to hold the carriage 14 when inserted therein. The container 12 also includes a closed lower end 24.

Figure 2A:
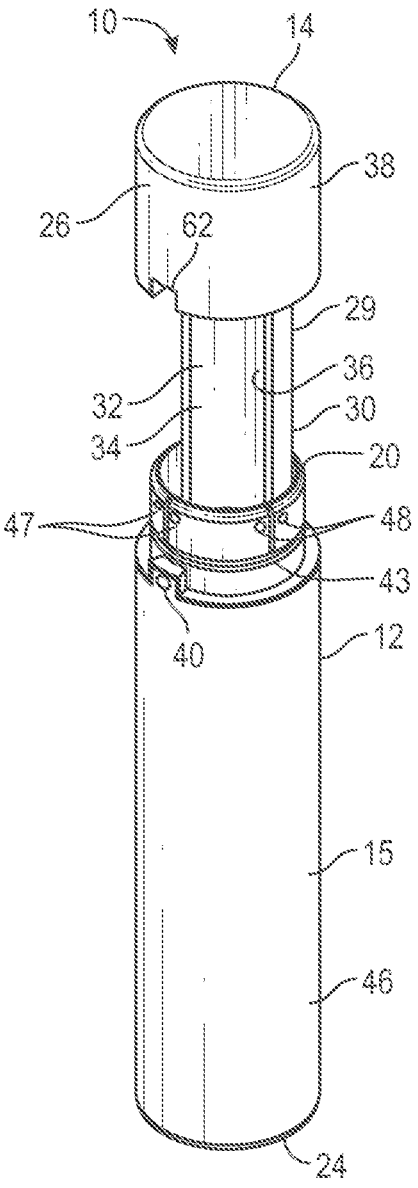
FIG. 2A is a perspective view of the storage apparatus of FIG. 1A, but showing the carriage having a cap on the upper end thereof detached and partially withdrawn from the container.
Figure 2B:
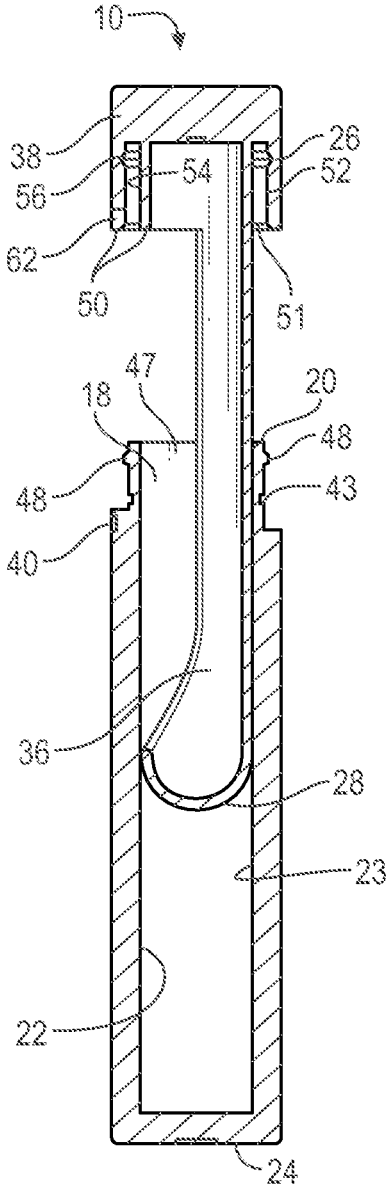
FIG. 2B is a cross-sectional view of the storage apparatus of FIG. 2A.

As illustrated by FIGS. 1B and 2A-2B, the storage apparatus 10 also includes an inner container or carriage 14 which includes both a closed upper end 26 and a closed lower end 28 and a perimeter wall 29 positioned therebetween. The closed lower end 28 may be rounded, such as the concave closed lower end 28. However, it will be appreciated that either the closed upper end 26 and/or the closed lower end 28 may be planar, concave, or any other shape which operates to hold at least one smoking product without cause damage to the smoking product. The carriage 14 includes an outer peripheral surface 30 and an opening 32 within the outer peripheral surface 30 which forms an inner surface 34 and a housing 36. The closed upper end 26 of the carriage provides a cap 38 for closing the opening 18 in the upper end 20 of the container 12. It will further be understood that while the present storage apparatus 10 and the container 12 and carriage 14 thereof are cylindrical or tubular in general shape, that any shape or configuration of either the container 12 or the carriage 14 may be used, as long as the storage apparatus operates as shown and described in detail herein.

Turning back to the container 12, shown in FIGS. 3A and 3B, the upper end 20 and outer peripheral surface 16 adjacent thereto includes a tab 40. Immediately above the tab 40 is a groove 43 which extends about the outer peripheral surface 16. A gasket or O-ring (not shown) may be positioned within the groove 43 so that when the cap 38 is applied, the storage apparatus 10 will be resistant to gases or liquids. Alternatively, the upper end 20 may include a ledge (not shown) for holding a gasket or O-ring (not shown). It will be appreciated in viewing the upper end 20 that the outer peripheral surface 16 adjacent to the upper end 20 has an upper end outer perimeter 44 which is smaller than a lower end outer perimeter 46. The upper end outer perimeter 44 may include, positioned desirably above the groove 43, a plurality of detents spring tabs 47 having a plurality of detents 48 positioned thereon. The plurality of detent spring tabs 47 are defined by a plurality of slits 49 which form the plurality of detent spring tabs 47, to permit a fit of the upper end 20 of the container 12 to fit within the sleeve 50 formed in the cap 38 of the carriage 14.

Figure 4A:
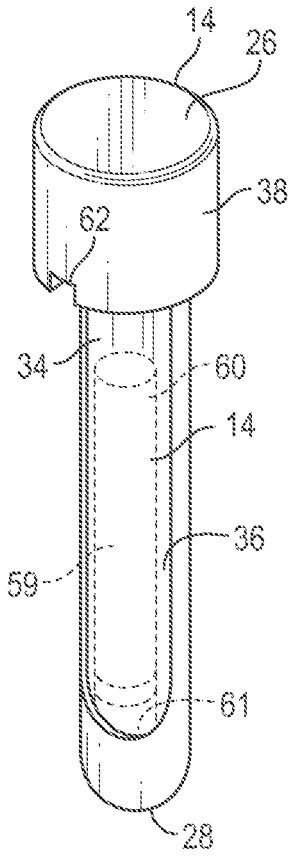
FIG. 4A is a perspective view of the carriage of the storage apparatus of FIG. 1A-1B, but showing only the carriage.
Figure 4B:
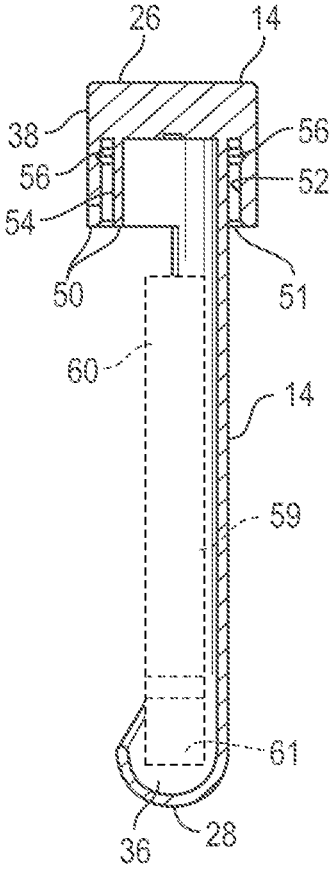
FIG. 4B is a cross-sectional view of FIG. 4A.

And now turning back to the carriage 14, the cap 38, as illustrated in FIGS. 4A-4B (and FIGS. 1B, 2A-2B), includes an opening 51 defined by a first sleeve wall 52 and an adjacent second sleeve wall 54 which forms the sleeve 50 within the cap 38. Each first and second sleeve walls 52, 54 are positioned such that the outer surface of the first sleeve wall 52 is the outer peripheral surface 30 of the cap 38 and the upper end 26. The innermost surface of the second sleeve wall 54 is the inner surface 34 of the carriage 14. A groove or detent recess 56 is formed within the first sleeve wall 52 and extends thereabout and the plurality of detents 44 extend into the detent recess 56 when the cap 38 is positioned over and releasably connected to the upper end 20 of the container 12, as shown in FIG. 1B. This combination, i.e., the plurality of detents 48 of the upper end outer perimeter 44 of the container 12 and the detent recess 56 in the first sleeve wall 52 of the sleeve 50 operate to provide a releasable closure due to the resilient material of at least one of the cap 38 and the upper end outer perimeter 44 of the container 12. The plurality of detents 48 are configured to engage the detent recess 56 along the first sleeve wall 52 of the cap 38 to provide a releasable connection. The plurality of detents 48 will snap or spring into the detent recess 56 when the carriage 14 is fully inserted into the container 12. The plurality of detents 48 and the detent recess 56 are easily connected and disconnect, due to the resilient and flexible material used. It will be appreciated, however, that other mechanisms, such as latches, snap fit, magnetic connectors, screw connections, an interference fit, and the like. However, when a user opens the storage apparatus 10, it is important to include an indicator as to the location of the housing 36 and the opening 32 within the carriage, so that the smoking product does not inadvertently fall through the opening 32. To this end, the storage apparatus 10 includes an indicator mechanism 58 to indicate to a user the opening 32 in the housing 36 of the carriage 14 which is otherwise hidden when the carriage 14 is positioned within the container 12. Also illustrated in FIGS. 4A and 4B, in phantom lines, is a smoking product 59 having a smokable or smoked end 61 and a lightable or lit end 60.

As illustrated in FIGS. 1A, 2A, and 3A, the indicator mechanism 58 of the smoking apparatus 10 includes the tab 40 which extends upward from the outer peripheral surface 16 of the container 12, in the upper end outer perimeter 44 thereof. Cooperatively, a slot 62 is formed in the cap 38 which may be aligned by a user with the tab 40. The tab 40 and the slot indicate to a user the correct position, namely, the location of the opening 32 in the housing 36 of the carriage 14 when opening and closing the storage container 10. The indicator mechanism 58 permits the user in order to retain a smoked product safely within the housing 36 of the carriage. The slot 62 and the tab 40 further operate to prevent rotation of the container 12 and the carriage 14 with respect to each other, thereby holding both the container 12 and the carriage 14 in a fixed, non-rotatable position. The indicator mechanism may also be any mechanism known in the art which would operate as shown and described in detail herein. For example, but not by way of limitation, other mechanisms may include a latch, a snap-fit, a magnetic lock, an interference fit, or a simple visual indicator.

In one method of use, a user of smoking products, using the indicator mechanism 58 to verify the location of the opening 32 into the housing 36 of the carriage 14, releases the resilient connection between the container 12 and the carriage 14 by moving the cap 38 upward away from the upper end 20 of the container 12. This action moves the carriage 14 upward slidably through container 12 and out of at least a portion of the storage area 23 of the container 12 until the opening 32 into the housing 36 permits access to the smoking product 59. When the smoking product 59 is exposed sufficiently, the user grasps (for example, between a thumb and index finger) the smoking product 59 and removes it through the opening 32 in the housing 36 and out of the carriage 14. To position a smoking product 59 in the carriage 14 and the container 12, the process is simply reversed.

Figure 5A:
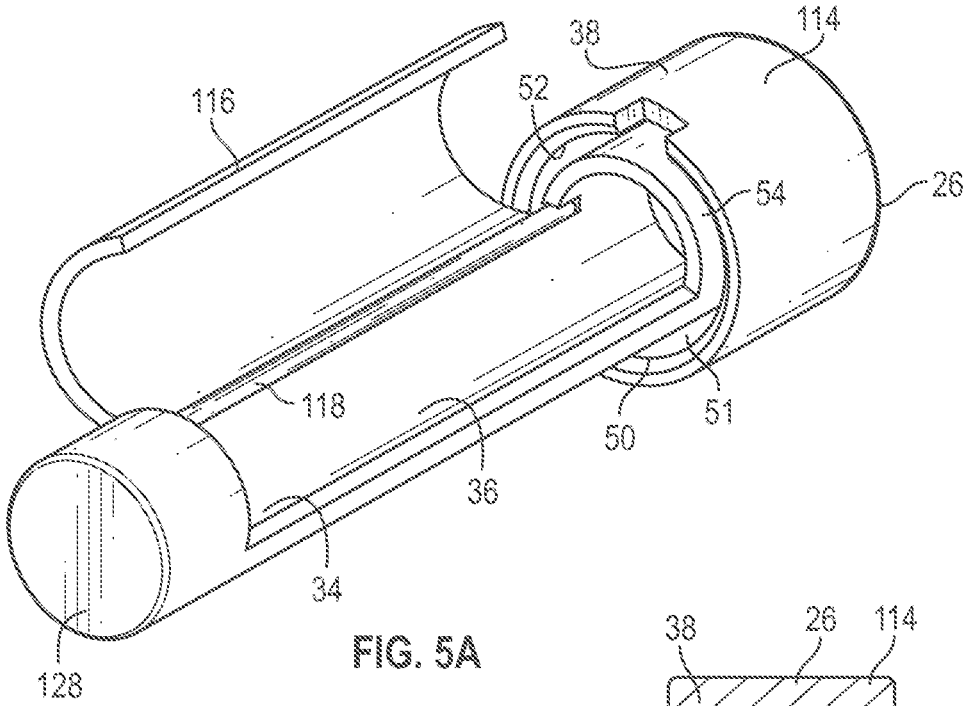
FIG. 5A is a perspective view similar to FIG. 4A, but showing a door attached to the carriage, and a planar lower end of the carriage.
Figure 5B:
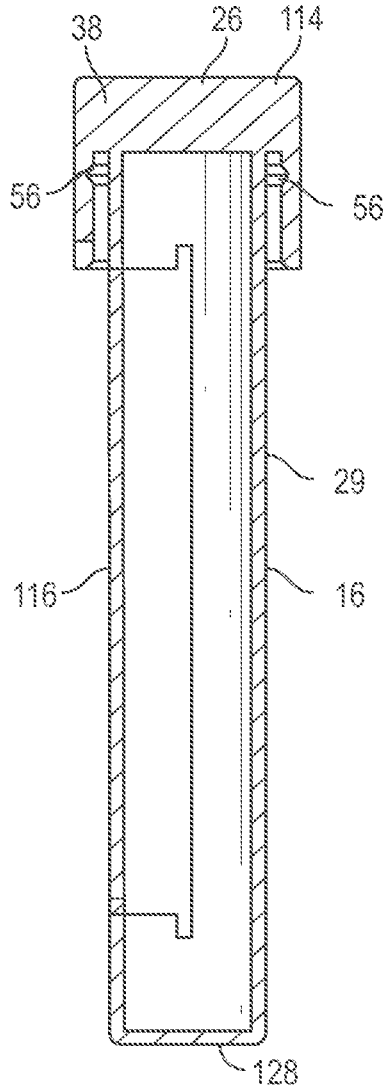
FIG. 5B is a cross-sectional view of FIG. 5A.

FIGS. 5A and 5B illustrate a carriage 114 very similar to carriage 14, except that carriage 114 includes a door 116 which may be connected by a hinge 118, in this instance a living hinge (or by any other hinge(s) or component(s) known in the art), to the perimeter wall 29 of the carriage 114. The carriage 114 also includes a planar closed lower end 128. Desirably, the door 116 covers the opening 32 at least partially and more desirably completely, to retain the smoking product 59 within the housing 36 of the carriage 114 and further isolate the smoking product 59 from the inner surface 22 of the container 12.

Figure 6A:
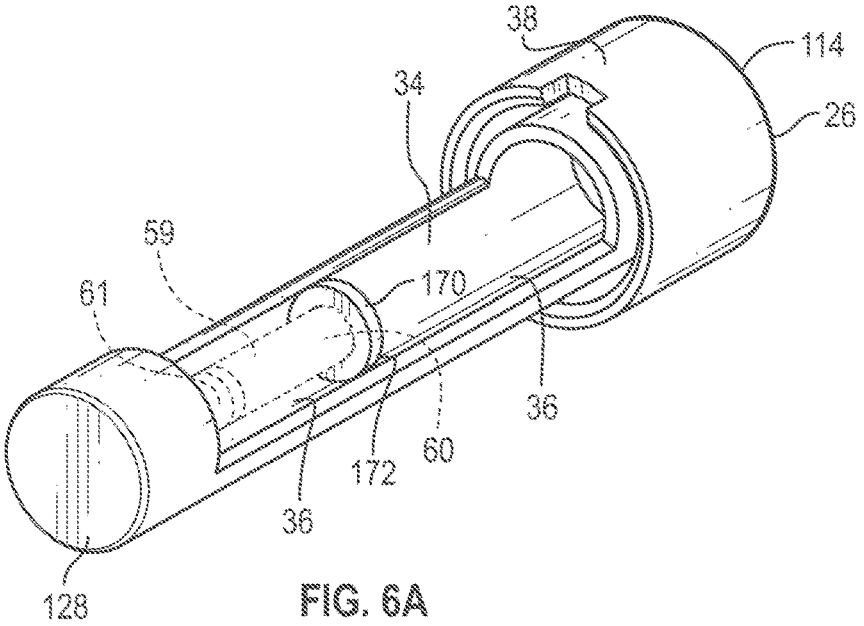
FIG. 6A is a perspective view of the carriage of the storage apparatus similar to FIG. 4A, but showing a planar lower end, and a disk positioned within the carriage and a partially smoked smoking product positioned between the lower end of the carriage and the disk.
Figure 6B:
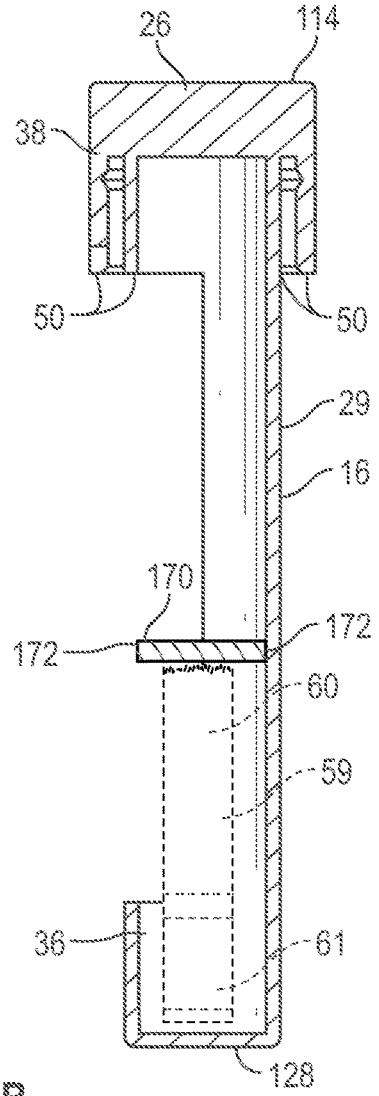
FIG. 6B is a cross-sectional view of FIG. 6A.

FIGS. 6A and 6B illustrate a carriage 114 which is similar to the carriage shown in FIGS. 5A and 5B, except that the present carriage 114 does not include a door, but the carriage 114 does include a moveable and removeable disk 170 positioned with in the housing 36. In one embodiment, the disk 170 may be frictionally inserted and positioned within the housing 36. It will be appreciated that an edge 172 of the disk 170 may have a releasable adhesive, cohesive, or other material to permit the edge 172 of the disk 170 to connect to the inner surface 34 of the housing 36 of the carriage 114. The disk 170 may be, but not by way of limitation, substantially planar, and it is desirably positioned parallel to at least one of the upper end 26 and the lower end 28 of the carriage 114 so that the previously lit end 60 of the partially smoked smoking product 59 is positioned against the disk 170. The partially smoked smoking product 59 is desirably positioned within the housing 36 with the previously lit end 60 of the smoking product 59 positioned against the disk 170, and with the smoking end 61 positioned against one end 26, 28 of the carriage 114 (in this present example, the closed lower end 28). This position holds the previously partially smoked smoking product 59 in a fixed position within the housing 36, to prevent damage to the delicate outer wrapper of the previously smoked product 59, and to prevent any loose material held within the outer wrapper from falling from the previously smoked product 59. The disk 170 may be formed from a resilient, flexible material, such as plastics described in detail herein, and the disk 170 may include a fire resistant material, such as, for example only, a metal, a ceramic, gypsum, and the like (all of which are commercially available), which may be positioned next to the previously lit end 60 of the partially smoked smoking product 59. It will be understood that the disk 170 may be stored in the carriage 114, such as in the housing 36 near the upper end 26 or the lower end thereof, or alternative in the lower end 24 of the container 12.

Figure 7A:
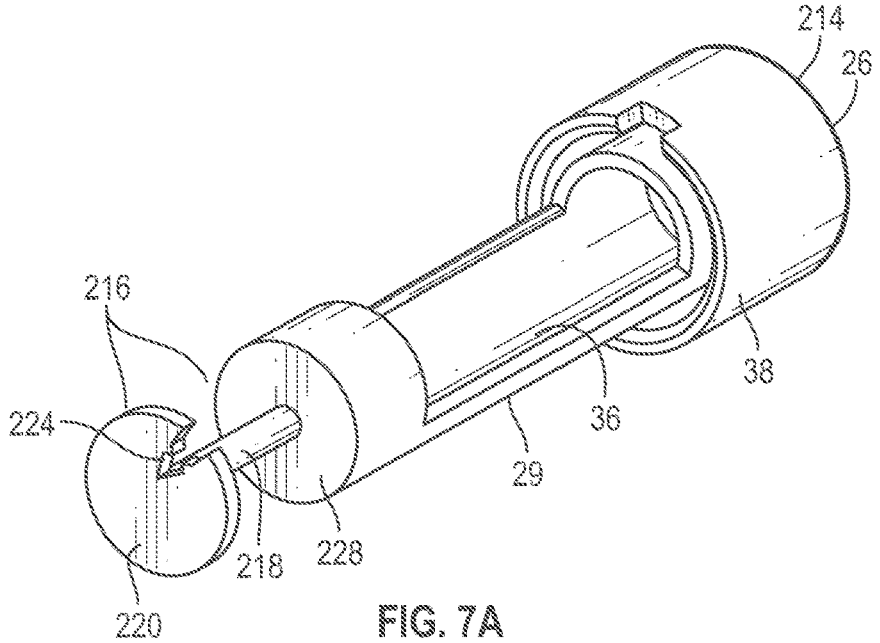
FIG. 7A is a perspective view of the carriage of the storage apparatus similar to FIG. 4A, but showing a planar lower end, and a spool assembly positioned on a lower end of the carriage, the spool assembly including a rod and a spool disk.
Figure 7B:
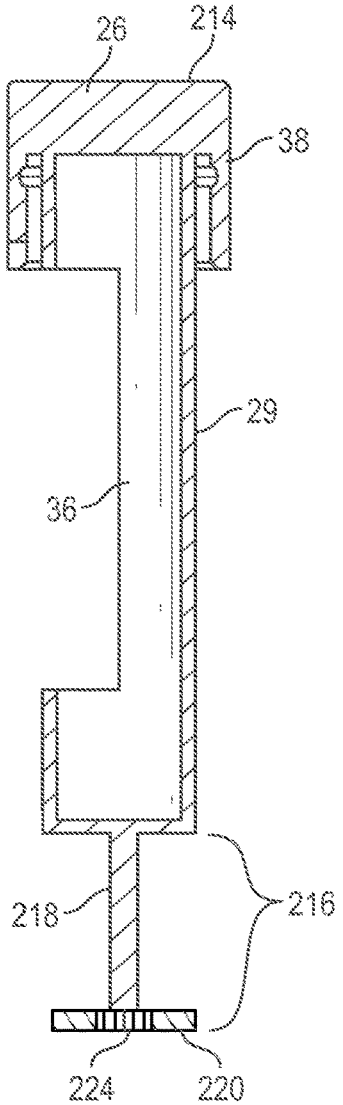
FIG. 7B is a cross-sectional view of FIG. 7A.

In another alternative, a carriage 214 is shown in FIGS. 7A and 7B, which is substantially similar to the carriage 14 and 114, except that carriage 214 includes, at the lower end 228 thereof, a spool assembly 216 which includes a rod 218 axially aligned with the carriage 214, and a spool disk 220 connected thereto, both of which extend from the lower end 28 of the carriage 214. The spool disk 220 includes a slit 224 formed in a portion of an outer periphery 226 of the spool disk 220.

Figure 7C:
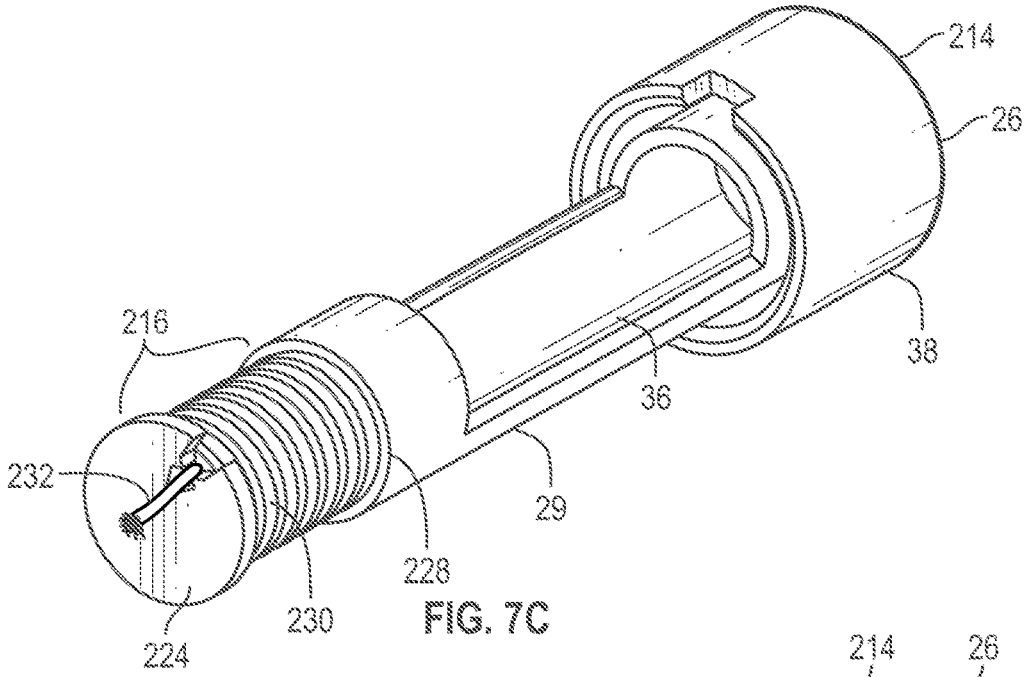
FIG. 7C is a perspective view of the carriage of the storage apparatus of FIG. 7A, but showing a hemp cord wound about the rod between the lower end of the carriage and the spool disk.
Figure 7D:
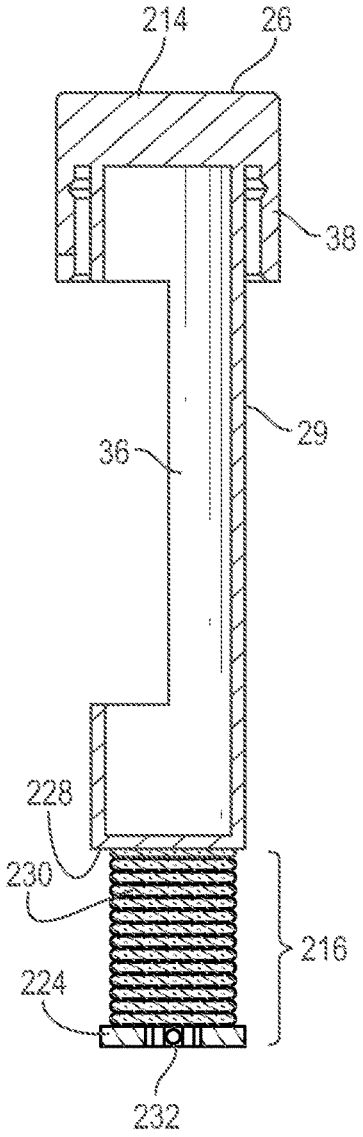
FIG. 7D is a cross-sectional view of FIG. 7C.
Figure 7E:
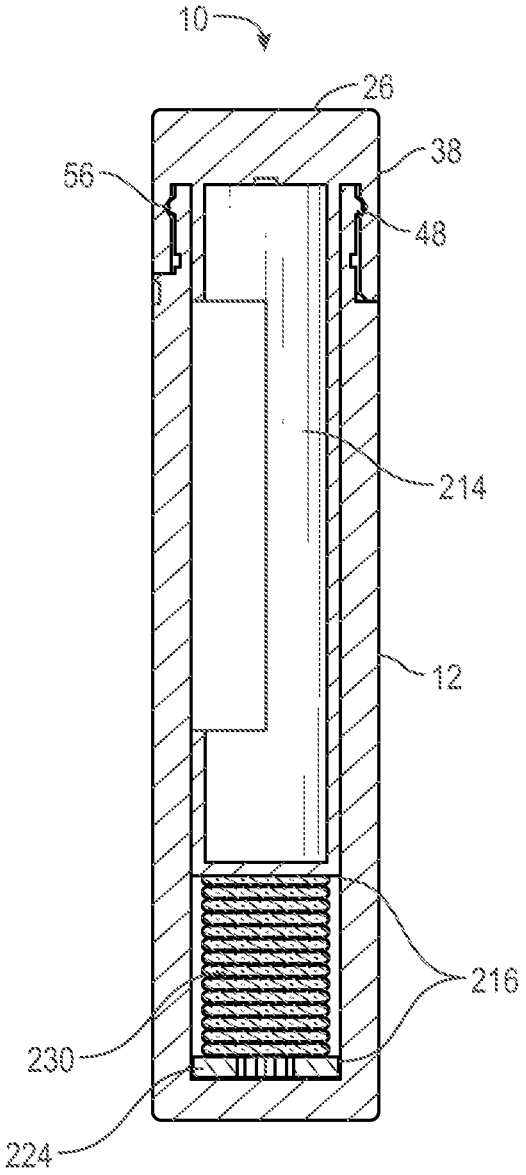
FIG. 7E is a cross-sectional view of similar to FIG. 7D, but showing the container as well as the carriage.

FIGS. 7C, 7D and 7E illustrate a hemp cord 230, which is commonly desired and used by certain smoking products customers to light the smoking product 59. Lighter fluid, and the like, contained within lighters, may have a negative smell and even a negative taste to the user when it is used to light the smoking product 59, but a hemp cord 230 does not create this undesirable smell or taste. The hemp cord 230 is wound about the rod 218 between the lower end 228 of the carriage 214 and the spool disk 220. The free end 232 of the hemp cord 230 is retained within the slit 224 of the spool disk 220, for the user's convenience. As shown in FIG. 7E, a standard container 10 may be used with the carriage 214.

Figure 8A:
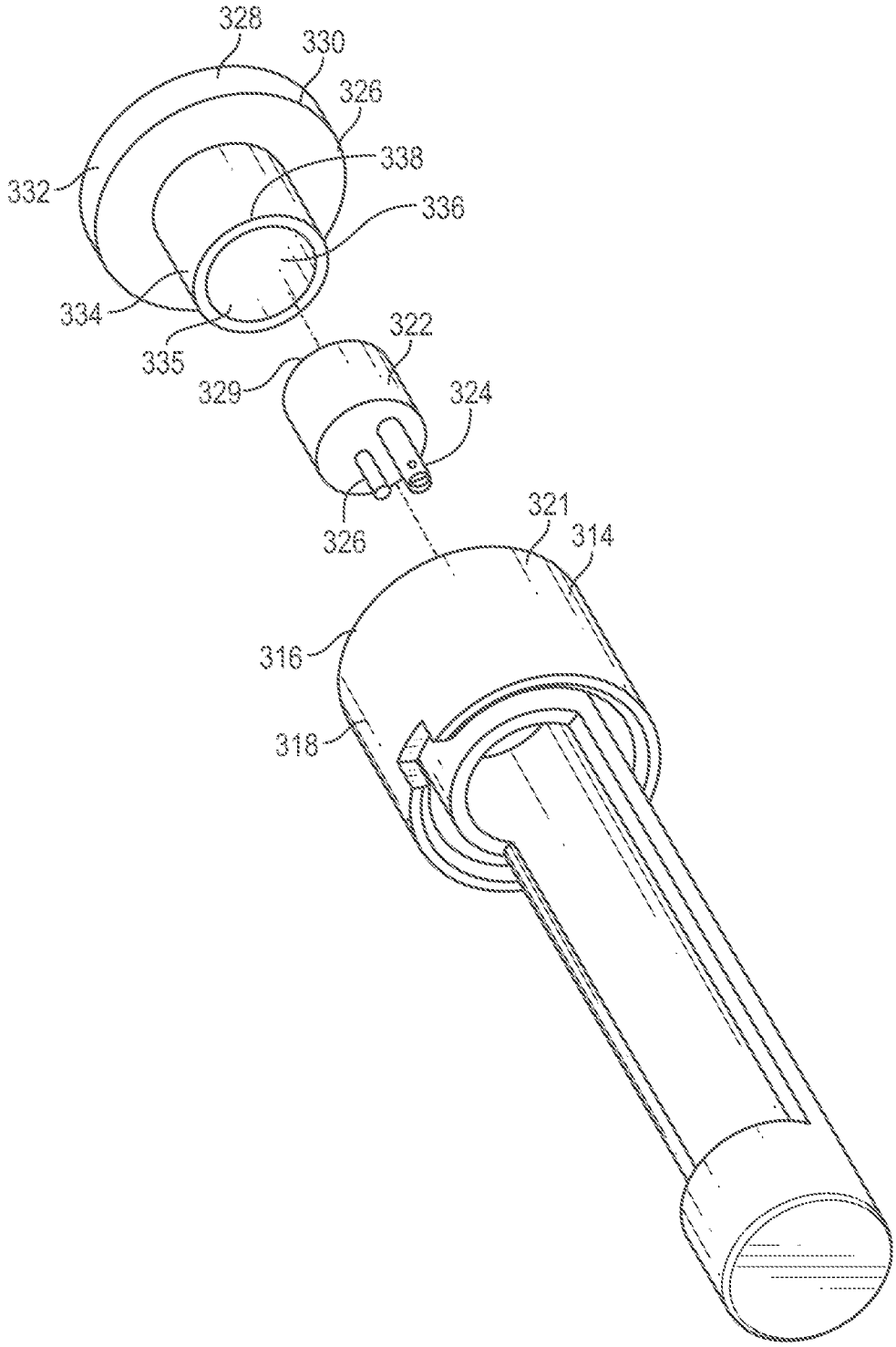
FIG. 8A is an exploded perspective view of the carriage of the storage apparatus similar to FIG. 4A, but showing a planar lower end, and showing a lighter with a holder which is positioned in the cap of the carriage.
Figure 8B:
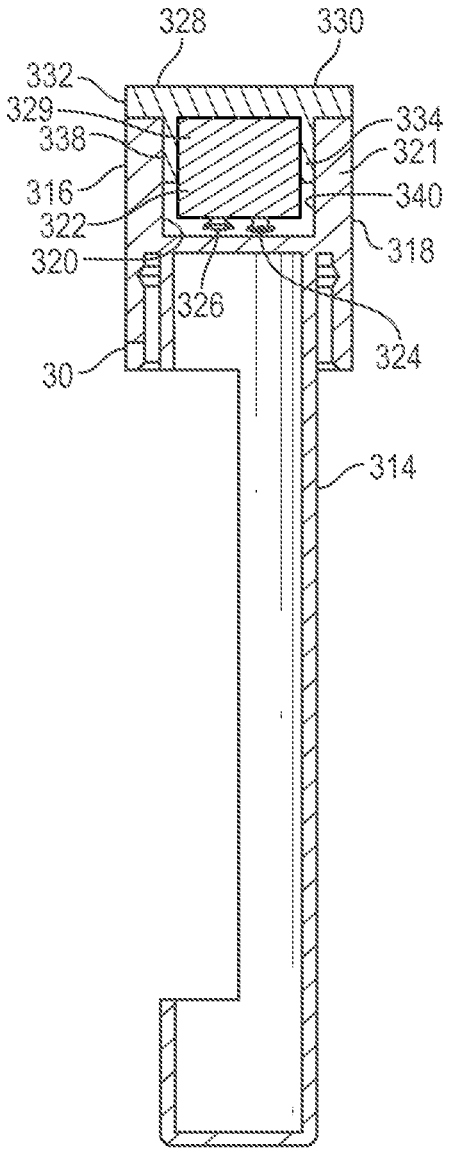
FIG. 8B shows a cross-sectional view of the carriage and the lighter with the holder positioned within the cap.

Turning now to FIGS. 8A and 8B, a carriage 314 which is substantially similar to the carriage 14 and 114 is illustrated, except that the upper end 316 and cap 318 of the carriage 314 are modified to include an opening 320 defined by an upper peripheral sidewall 321. A lighter assembly 322, which includes a holder 328, is configured to fit substantially within the opening 320. The lighter assembly 322 includes, on one end thereof, a flint 324 which creates a spark when activated. Positioned near or next to the flint 324 is the wick 326, which is holds a flame. An opposite end 329 of the lighter assembly 322 is configured to fit within the holder 328. The holder 328 includes a planar upper end 330 which may have a peripheral edge 332 configured to extend beyond the outer peripheral surface 30 of the carriage 314. The holder 328 includes a perimeter wall 334 having an opening 335 and an inner surface 336 sized to releasably hold the opposite end 329 of the lighter assembly 322 therein, via a frictional engagement, a releasable adhesive, a cohesive connection, and the like. An outer surface 338 of the perimeter wall 334 of the holder 328 is configured to be positioned against the inner surface 340 of the upper peripheral wall 321 of the cap 318. The lighter assembly 322 is used by removing the holder 328 which holds the lighter assembly 322 from the cap 318 and activating the flint 324, which may have a wheel 326 which is moved rapidly to create a spark (not shown) and the spark is transferred to the wick 326 which becomes the flame used to light the lit end 60 of the smoking product 59. The lighter assembly 322 may use any suitable lighter commercially available. Some commercially available lighter assemblies are available, for example, from numerous brick and mortar vendors and online vendors, including Amazon.com.

Figure 9A:
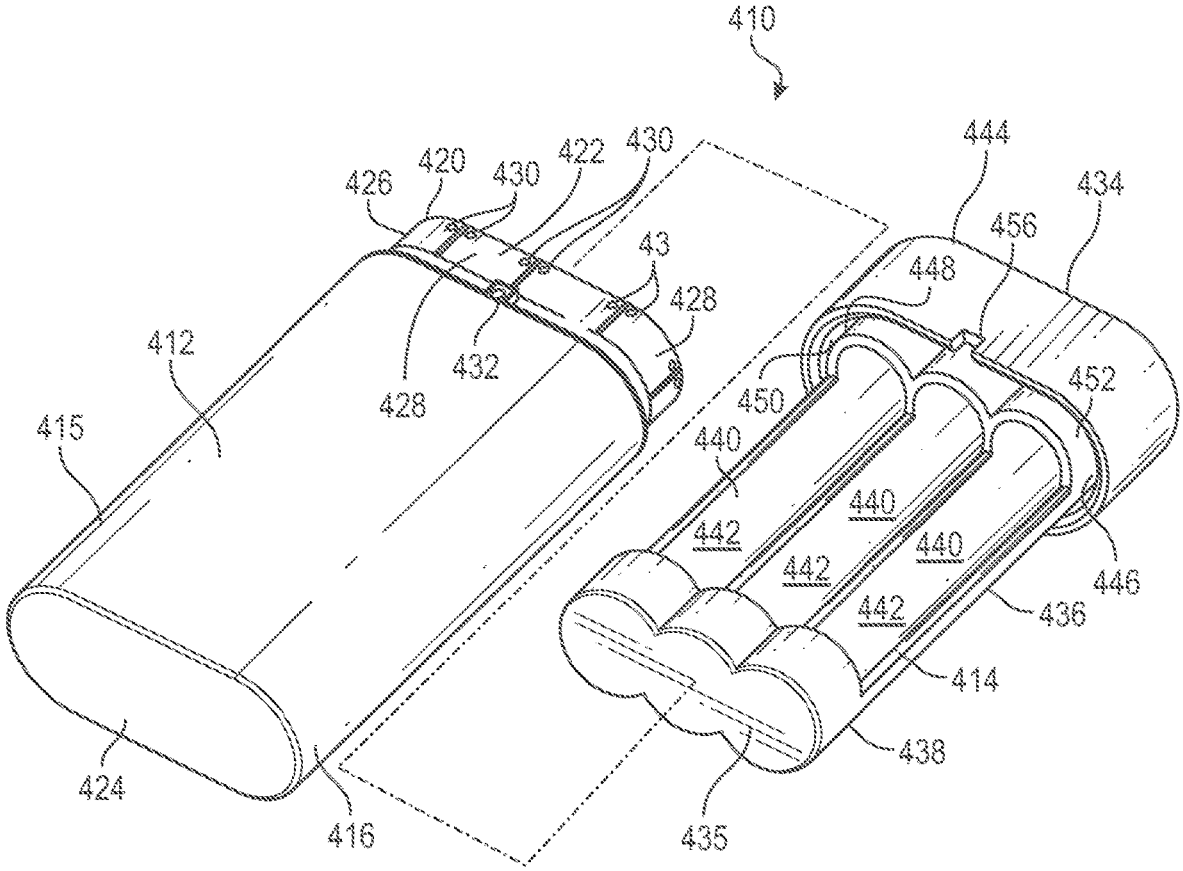
FIG. 9A is an exploded perspective view of a storage apparatus having a container configured to hold a plurality of carriages, and the plurality of carriages configured to be held within the container.
Figure 9B:
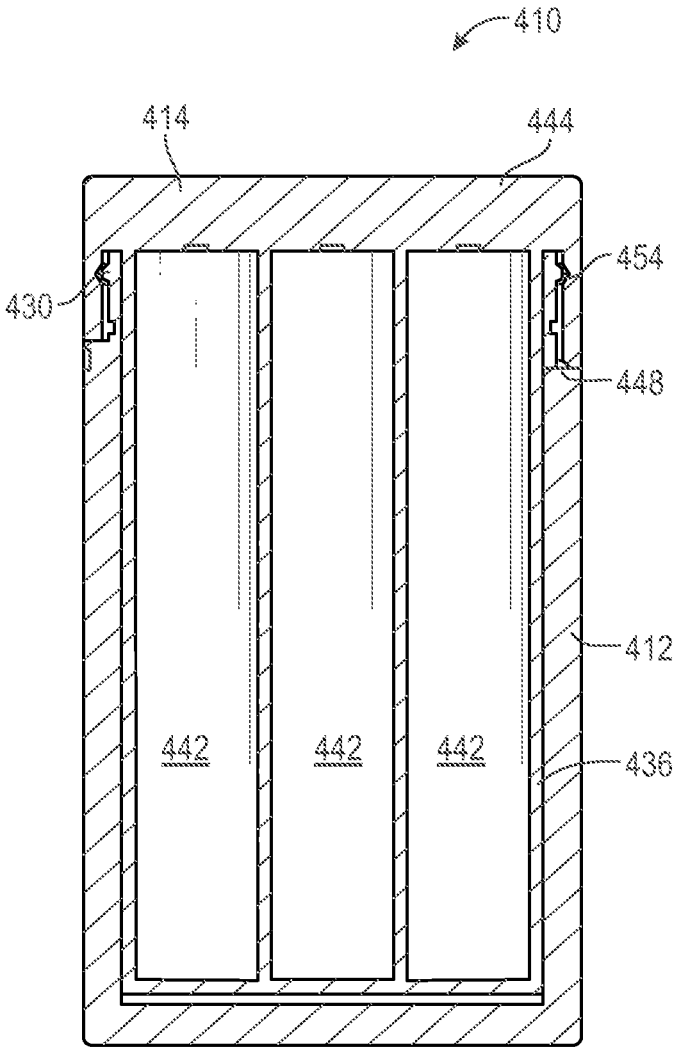
FIG. 9B is a cross-sectional view of the storage apparatus of FIG. 9A, but showing the carriage connected to the container.

While the previous embodiments of the storage apparatus used one container and one carriage, as shown in FIGS. 9A and 9B, an alternative storage apparatus 410 may include a container 412 configured to receive a plurality of carriages 414 within a single container 412. The container 412 is similar to the previous containers shown and described herein, except that the container 412 is a single container configured to accept a plurality of carriages 414 connected together (in this example, but not by way of limitation, three carriages). The container 412 includes a perimeter wall 415 having an outer peripheral surface 416 and upper end 420 having an opening 422 therein and a closed lower end 424. An upper end outer perimeter 426 includes a plurality of detent spring tabs 428 with a plurality of detents 430 positioned thereon, in this example, but not by way of limitation, one tab 432 on a central area of the container 412. Each carriage 414 includes a closed upper end 434 a closed lower end 435, an outer perimeter wall 436 positioned therebetween and having an outer peripheral surface 438. Each perimeter wall 436 may be shared with an internal adjoining carriage 414 as illustrated in FIG. 9B, or each perimeter of the plurality of carriages may be formed by separate perimeter walls for each carriage (not shown). Each carriage 414 includes an opening 440 therein into a housing 442 formed within each perimeter wall 436 configured to hold a smoking product. A cap 444 is formed within the closed upper end 434 of each carriage 414, and a single cap 444 is configured to extend over and about all of the plurality of closed upper ends 434 of the plurality of carriages 414. The cap 444 includes an opening 446 therein defining a sleeve 448 having spaced-apart first and second sleeve walls 450, 452, respectively, similar to the sleeve 50 previously shown and described herein. The first sleeve wall 450 of the sleeve 448 includes a groove or detent recess 454 to receive each of the plurality of detents 430 therein when the cap 444 of the plurality of carriages 414 is connected to the container 412. And, the cap 444 includes, in cooperatively positioned locations, a slot 456 is positioned to receive the tab 432 the therein, in order to guide the user with regard to which side of the storage apparatus 410 which includes access to the smoking products held within the plurality of carriages 414. It will be appreciated from the foregoing illustrations and detailed description that variations of the storage apparatus 410 are possible and hereby enabled herein. It will also be understood that a user will use the storage apparatus 410 in a manner similar to the method of use described herein previously.

The storage apparatus 10 or 410 may be manufactured using additive manufacturing (also known as three dimensional "3D" printing). 3D printing enables an apparatus having a complex geometry to be manufactured relatively quickly and easily and enables integration of the cap 38 with the carriage 14 without the use of glue or other joining methods. For example, but not by way of limitation, 3D manufacturing methods may include SLA (Stereolithography) where resin is cured in layers by a point based light source), DLP (Digital Light Processing) which is similar to SLA but uses a projection based light source, CDLP (Continuous Digital Light Projection) that is similar to DLP but with continuous curing, FDM (Fused Deposition Modeling) which is where molten plastic is deposited in layers, MJF (Multi Jet Fusion) which is powder based process where in a layer of plastic powder is selectively printed with inks that either encourage or inhibit melting when a heat source is passed over the layer, SLS (Selective Laser Sintering) that is a powder based process where a layer of plastic powder is selectively melted using a point based laser, DMLS (Direct Metal Laser Sintering) which is similar to SLS but for Metals, and SLM (Selective Laser Melting) that is similar to DMLS, but typically uses higher temperatures. The storage apparatus 10 may also be manufactured by way of injection molding or by machining, or other suitable manufacturing methods.

The storage apparatus 10 may comprise plastic, such as, for example only, nylon, ABS (Acrylonitrile Butadiene Styrene), PLA (Polylactic Acid or Polylactide), metals, such as, for example, but not by way of limitation, aluminum, steel, titanium, or other materials, such as, for example only, wood, and the like, or combinations of the foregoing, which will permit the storage apparatus 10 and 410 to be manufactured and used as shown and described in detail herein. It will be understood that the foregoing materials are readily commercially available.

The storage apparatus 10, including the container 12 and/or the carriage 14, may have any shape and/or size so long as the storage apparatus 10 operated as shown and described in detail herein. For example, but not by way of limitation, three dimensional shapes may include, but are not limited to, a Cube, Cuboid, Triangular Prism, Pentagonal Prism and Hexagonal Prism (or any-sided Prism).

The smoking product 59 is desirably stored vertically in the storage apparatus 10. It will be appreciated that the smoking product 59 is at least partially encased in its carriage 14, 214, 314, 414 and completely enclosed within its container 12 and 412. All embodiments and variations of the carriage 14, 114, 214, 314, 414 prevents interference or rubbing of the smoking product 59 against the inner surface 22 the container 12, thereby reducing a likelihood of accidental product damage or loss. Further, the disk 170 permits the smoking product 59 of any length to have both the smoking end 61 of the smoking product 59 and the lit end 60 (or to be lit) of the smoking product 59 to be positioned within the carriage 14, 114, 214, 314, 414 such that movement of the smoking product 59 and therefore the movement or rubbing of the delicate wrapper of the smoking product 59 against the inner surface of the carriage is reduced or eliminated. It will be further appreciated that use of the disk 170 within the housing 36 of the carriage further reduces loss of material and/or damage to the delicate wrapper of the smoking product 59, because the disk 170 may be used to retain and secure any loose material within the lit end 60 of the smoking product 59, which retains both the smoking product 59 and the storage apparatus 10, 410 in a tidy condition.

In the present storage apparatus 10, the smoking product 59 held in the carriage 14 is removed from the container 12 without having to tip the container 12 over to slide the smoking product 59 therefrom. This is important because it is not desirable to frictionally rub the delicate outer wrapper of the smoking product 59, which is accomplished with the present carriage 14 and container 12 of the storage apparatus 10. The present storage apparatus 10 also reduces a risk of dropping and damaging the smoking product 59 because the current storage apparatus, unlike a prior art container, does not require tipping and sliding the smoking product from such a prior art container. In addition, the disk 170 again is useful to hold the smoking product 59 in a desired position within the housing of the carriage. Use of the disk 170 within the carriage also reduces the risk of losing material from the smoking product, and also reduces the risk of any loose smoking product 59 from spilling out of the opening in the carriage as well. Moreover, it may be easier for users with limited mobility to remove the smoking product 59 from the storage apparatus 10 without needing to twist an arm and/or hand to tip and slide the smoking product 59 in and out of a prior art-type container. It will be appreciated that the disk 170 may be any size or shape which functions as shown and described in detail herein.

The carriage is configured to be versatile with regard to the type of mouth-end style of smoking product. That is, the carriage is configured to carry a smoking product that uses filter and/or is rigid, as well as one which does not use a filter and is less rigid and more fragile. The present carriage(s) shown and described in detail herein need not have or use a specifically designed holding mechanism, but if one is needed for a partially smoked smoking product 59, the disk 170 may be utilized to hold the smoking product 59 in a desired position to avoid the loss of loose material from the partially smoked smoking product 59, a illustrated in FIGS. 6A and 6B.

In another alternative, the cap 38 may be formed separately and may be removable via normal variations of such a component, i.e., by threaded and grooved areas of the upper end 20 of the container and one sleeve wall 52, 54 of the cap 38 (not shown). In addition, such a connection may be formed, releasably or non-releasably by any means or method known in the art and commercially available, such as, for example, but not by way of limitation, snap fits, glue, screws rivets, screw joint, mechanical fixture or connectors, and the like. In the storage apparatus illustrated in FIGS. 1-8, an inner dimension of the inner surface 22 and storage area 23 formed within the perimeter wall 15 of the container is only slightly greater than an outer dimension of the outer peripheral surface 30 of the perimeter wall 29 of the carriage 14. In this instance, the range between the inner dimension of the container and the outer dimension of the carriage is desirably 0.05 to 5 millimeters. Alternatively, the range between the inner dimension of the container and the outer dimension of the carriage is desirably 0.05 to 2 millimeters. In yet a further alternative, the range between the inner dimension of the container and the outer dimension of the carriage is desirably 0.05 to 1 millimeters. In addition, in the storage apparatus 10 illustrated in FIGS. 1-8, an outer dimension of the container (below the upper end outer perimeter 44) is substantially equivalent to an outer diameter of the cap of the carriage. However, for FIGS. 9A and 9B, due to the plurality of carriages 414 held within a single container 312, the inner dimension between an outer peripheral surface of the perimeter wall 415 of the container 412 and the outer dimension of the outer peripheral surface 438 of the perimeter wall 436 of the carriage is desirably in a range of between 0.05 millimeters to 2 centimeters. More desirably, the range is between 0.05 millimeters and 1 centimeter.

It will be appreciated that alternative lengths of both the carriage and the container may also be utilized with various features shown and described in detail herein. With regard to the ends of the carriage, it will be appreciated that a concave closed lower end or upper end (not shown) will more closely cup certain rolled smoking products which have rounded ends, to more closely conform to such rolled smoking products.

The description of the different embodiments has been presented for purposes of illustration and description, and it is not intended to be exhaustive or limited to the embodiments in the form disclosed. Modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A storage apparatus for storing a smoking product, the storage apparatus comprising:

a container having a perimeter wall having an upper end with an opening formed therein defining a storage area, and a closed lower end;

a carriage having a closed upper end including a cap, a closed lower end, and a perimeter wall positioned therebetween forming a housing, an opening formed in the housing to permit insertion and withdrawal of a smoking product;

wherein the carriage is configured to be inserted into the container and withdrawn from the container, and wherein the container is closed and opened by a releasable connection between the cap of the carriage and the upper end of the container, wherein an outer perimeter of the cap is substantially equivalent to an outer perimeter of the container positioned below the upper end outer perimeter thereof, and wherein the cap includes a sleeve, and a portion of the upper end of the container is held within the sleeve when the storage apparatus is in a closed position.

2. The storage apparatus of claim 1, wherein an outer perimeter of the carriage is smaller than an inner perimeter of the container.

3. The storage apparatus of claim 1, wherein the carriage includes a disk configured to be positioned within the housing of the carriage and to be positioned against an end of the smoking product to hold the smoking product in a fixed position within the housing.

4. The storage apparatus of claim 1, wherein the cap of the carriage and the upper end of the container include means for connecting the carriage and the container together, the means including a plurality of detents on an upper end of the container and a detent recess formed within the sleeve.

5. The storage apparatus of claim 4, wherein the storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

6. A storage apparatus for storing a smoking product, the storage apparatus comprising:

container having a perimeter wall having an upper end with an opening formed therein defining a storage area, and a closed lower end;

a carriage having a closed upper end including a cap, a closed lower end, and a perimeter wall positioned therebetween forming a housing, an opening formed in the housing to permit insertion and withdrawal of a smoking product;

wherein the carriage is configured to be inserted into the container and withdrawn from the container, and wherein the container is closed and opened by a releasable connection between the cap of the carriage and the upper end of the container, wherein the carriage includes a door to close the opening in the housing.

7. A storage apparatus for storing a smoking product, the storage apparatus comprising:

a container having a perimeter wall having an upper end with an opening formed therein defining a storage area, and a closed lower end;

a carriage having a closed upper end including a cap, a closed lower end, and a perimeter wall positioned therebetween forming a housing, an opening formed in the housing to permit insertion and withdrawal of a smoking product;

wherein the carriage is configured to be inserted into the container and withdrawn from the container, and wherein the container is closed and opened by a releasable connection between the cap of the carriage and the upper end of the container, wherein the closed end of the carriage includes a spool assembly which includes a rod and spaced-apart disk connected thereto, the spool assembly configured to receive a lighting product wound about the rod between the closed end of the carriage and the disk, wherein the lighting product is used to light the smoking product.

8. A storage apparatus for storing a smoking product, the storage apparatus comprising:

a container having a perimeter wall having an upper end with an opening formed therein defining a storage area, and a closed lower end;

a carriage having a closed upper end including a cap, a closed lower end, and a perimeter wall positioned therebetween forming a housing, an opening formed in the housing to permit insertion and withdrawal of a smoking product;

wherein the carriage is configured to be inserted into the container and withdrawn from the container, and wherein the container is closed and opened by a releasable connection between the cap of the carriage and the upper end of the container, wherein the cap includes a lighter for lighting the smoking product.

9. A storage apparatus for storing a smoking product, the storage apparatus comprising:

a container having a perimeter wall having an upper end with an opening formed therein defining a storage area, and a closed lower end;

a carriage having a closed upper end including a cap, a closed lower end, and a perimeter wall positioned therebetween forming a housing, an opening formed in the housing to permit insertion and withdrawal of a smoking product;

wherein the carriage is configured to be inserted into the container and withdrawn from the container, and wherein the container is closed and opened by a releasable connection between the cap of the carriage and the upper end of the container, wherein the storage apparatus comprises a plurality of carriages and the container is configured to receive the plurality of carriages.

10. The storage apparatus of claim 1, including at least one of 1) a door to close the opening in the housing of the carriage, 2) a spool assembly which includes a rod and spaced-apart disk connected thereto, the spool assembly configured to receive a lighting product wound about the rod between the closed end of the carriage and the disk, wherein the lighting product is used to light the smoking product, 3) a lighter for lighting the smoking product, the lighter carried by the cap, and 4) a plurality of carriages held in the container which configured to receive the plurality of carriages.

11. The storage apparatus of claim 6, wherein an outer perimeter of the carriage is smaller than an inner perimeter of the container.

12. The storage apparatus of claim 6, wherein the carriage includes a disk configured to be positioned within the housing of the carriage and to be positioned against an end of the smoking product to hold the smoking product in a fixed position within the housing.

13. The storage apparatus of claim 6, wherein an outer perimeter of the cap is substantially equivalent to an outer perimeter of the container positioned below the upper end outer perimeter thereof.

14. The storage apparatus of claim 13, wherein the cap includes a sleeve, and a portion of the upper end of the container is held within the sleeve when the storage apparatus is in a closed position.

15. The storage apparatus of claim 14, wherein the cap of the carriage and the upper end of the container include means for connecting the carriage and the container together, the means including a plurality of detents on an upper end of the container and a detent recess formed within the sleeve.

16. The storage apparatus of claim 15, wherein the storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

17. The storage apparatus of claim 6, including at least one of 1) a spool assembly which includes a rod and spaced-apart disk connected thereto, the spool assembly configured to receive a lighting product wound about the rod between the closed end of the carriage and the disk, wherein the lighting product is used to light the smoking product, 2) a lighter for lighting the smoking product, the lighter carried by the cap, and 3) a plurality of carriages held in the container which configured to receive the plurality of carriages.

18. The storage apparatus of claim 7, wherein an outer perimeter of the carriage is smaller than an inner perimeter of the container.

19. The storage apparatus of claim 7, wherein the carriage includes a disk configured to be positioned within the housing of the carriage and to be positioned against an end of the smoking product to hold the smoking product in a fixed position within the housing.

20. The storage apparatus of claim 7, wherein an outer perimeter of the cap is substantially equivalent to an outer perimeter of the container positioned below the upper end outer perimeter thereof.

21. The storage apparatus of claim 20, wherein the cap includes a sleeve, and a portion of the upper end of the container is held within the sleeve when the storage apparatus is in a closed position.

22. The storage apparatus of claim 21, wherein the cap of the carriage and the upper end of the container include means for connecting the carriage and the container together, the means including a plurality of detents on an upper end of the container and a detent recess formed within the sleeve.

23. The storage apparatus of claim 22, wherein the storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

24. The storage apparatus of claim 7, including at least one of 1) a door to close the opening in the housing of the carriage, 2) a lighter for lighting the smoking product, the lighter carried by the cap, and 3) a plurality of carriages held in the container which configured to receive the plurality of carriages.

25. The storage apparatus of claim 8, wherein an outer perimeter of the carriage is smaller than an inner perimeter of the container.

26. The storage apparatus of claim 8, wherein the carriage includes a disk configured to be positioned within the housing of the carriage and to be positioned against an end of the smoking product to hold the smoking product in a fixed position within the housing.

27. The storage apparatus of claim 8, wherein an outer perimeter of the cap is substantially equivalent to an outer perimeter of the container positioned below the upper end outer perimeter thereof.

28. The storage apparatus of claim 27, wherein the cap includes a sleeve, and a portion of the upper end of the container is held within the sleeve when the storage apparatus is in a closed position.

29. The storage apparatus of claim 28, wherein the cap of the carriage and the upper end of the container include means for connecting the carriage and the container together, the means including a plurality of detents on an upper end of the container and a detent recess formed within the sleeve.

30. The storage apparatus of claim 29, wherein the storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

31. The storage apparatus of claim 8, including at least one of 1) a door to close the opening in the housing of the carriage, 2) a spool assembly which includes a rod and spaced-apart disk connected thereto, the spool assembly configured to receive a lighting product wound about the rod between the closed end of the carriage and the disk, wherein the lighting product is used to light the smoking product, and 3) a plurality of carriages held in the container which configured to receive the plurality of carriages.

32. The storage apparatus of claim 9, wherein an outer perimeter of the carriage is smaller than an inner perimeter of the container.

33. The storage apparatus of claim 9, wherein the carriage includes a disk configured to be positioned within the housing of the carriage and to be positioned against an end of the smoking product to hold the smoking product in a fixed position within the housing.

34. The storage apparatus of claim 9, wherein an outer perimeter of the cap is substantially equivalent to an outer perimeter of the container positioned below the upper end outer perimeter thereof.

35. The storage apparatus of claim 34, wherein the cap includes a sleeve, and a portion of the upper end of the container is held within the sleeve when the storage apparatus is in a closed position.

36. The storage apparatus of claim 35, wherein the cap of the carriage and the upper end of the container include means for connecting the carriage and the container together, the means including a plurality of detents on an upper end of the container and a detent recess formed within the sleeve.

37. The storage apparatus of claim 36, wherein the storage apparatus includes an indicator mechanism including a tab formed in the upper end of the container and a slot formed within the cap of the carriage, to indicate to a user a location of the opening in the housing of the carriage in order to access the smoking product, and wherein when the tab is positioned within the slot, the container and carriage are locked together to prevent rotation.

38. The storage apparatus of claim 9, including at least one of 1) a door to close the opening in the housing of the carriage, 2) a spool assembly which includes a rod and spaced-apart disk connected thereto, the spool assembly configured to receive a lighting product wound about the rod between the closed end of the carriage and the disk, wherein the lighting product is used to light the smoking product, and 3) a lighter for lighting the smoking product, the lighter carried by the cap.

* * * * *